US007850628B2

(12) United States Patent
Beiruti

(10) Patent No.: US 7,850,628 B2
(45) **Date of Patent: *Dec. 14, 2010**

(54) FLEXING MULTIPLE FUNCTION INTERACTIVE MASSAGE AND REFLEXOLOGY UNIT

(76) Inventor: Ahmad M. Beiruti, P.O. Box 2872, La Jolla, CA (US) 92038

( * ) Notice: Subject to any disclaimer, the term of this patent is extended or adjusted under 35 U.S.C. 154(b) by 0 days.

This patent is subject to a terminal disclaimer.

(21) Appl. No.: 12/348,126

(22) Filed: Jan. 2, 2009

(65) Prior Publication Data

US 2010/0175275 A1 Jul. 15, 2010

Related U.S. Application Data

(63) Continuation of application No. 11/705,369, filed on Feb. 12, 2007, now abandoned, which is a continuation of application No. 10/654,179, filed on Sep. 3, 2003, now Pat. No. 7,250,033.

(51) Int. Cl.
*A61H 19/00* (2006.01)

(52) U.S. Cl. ..... 601/134; 601/136

(58) Field of Classification Search ..... 601/134–136; 36/43, 141

See application file for complete search history.

(56) References Cited

U.S. PATENT DOCUMENTS

| | | | | |
|---|---|---|---|---|
| 4,631,221 | A | 12/1986 | Disselbeck et al. | |
| 4,633,597 | A | 1/1987 | Shiang | |
| 4,670,995 | A | 6/1987 | Huang | |
| 4,934,071 | A | 6/1990 | Virgini | |
| 5,251,387 | A * | 10/1993 | Jurgens | 36/43 |
| 5,517,770 | A * | 5/1996 | Martin et al. | 36/43 |
| 5,607,749 | A | 3/1997 | Strumor | |
| 5,669,161 | A | 9/1997 | Huang | |
| 5,784,807 | A | 7/1998 | Pagel | |
| 5,896,680 | A | 4/1999 | Kim et al. | |
| 6,098,313 | A * | 8/2000 | Skaja | 36/28 |
| 6,105,279 | A * | 8/2000 | Bouchoms | 36/25 R |
| 6,219,941 | B1 | 4/2001 | Kukoff | |
| 6,425,194 | B1 | 7/2002 | Brie | |
| 6,430,843 | B1 | 8/2002 | Potter et al. | |
| 6,470,600 | B1 * | 10/2002 | Louie | 36/113 |

FOREIGN PATENT DOCUMENTS

| | | |
|---|---|---|
| DE | 2024534 | 12/1971 |
| EP | 0464000 | 2/1992 |
| EP | 0875163 | 4/1998 |
| WO | WO9424980 | 11/1994 |

* cited by examiner

*Primary Examiner*—Michael A. Brown
(74) *Attorney, Agent, or Firm*—Stetina Brunda Garred & Brucker

(57) ABSTRACT

Disclosed is a massaging and reflexology system for an article of footwear comprising a core body generally configured in the shape of a shoe insole, a plurality of cups disposed on a top surface of the shoe insole, and a respective bump or pressure nub disposed within each of the cups. The cups may be disposed on a bottom surface of the core body. The shoe insole may define toe, intermediate, heel and arch portions, or any combination thereof. Each cup may define a substantially concave surface projecting outwardly from the top surface with the cup perimeters being generally circular. The pressure nubs may be centrally disposed on the concave surface of each one of the cups on the top surface. The core body, the cups, the cup spacers and the pressure nubs may be formed as a unitary structure of resilient, elastomeric material such as silicone gel.

26 Claims, 6 Drawing Sheets

FLEXING MULTIPLE FUNCTION INTERACTIVE MASSAGE AND REFLEXOLOGY UNIT

CROSS-REFERENCE TO RELATED APPLICATIONS

The present application is a continuation application of prior U.S. patent application Ser. No. 11/705,369, filed Feb. 12, 2007 which is a continuation of prior U.S. patent application Ser. No. 10/654,179, filed Sep 3, 2003, now U.S. Pat. No. 7,250,033, the entirety of the disclosures of which are expressly incorporated herein by reference.

STATEMENT RE: FEDERALLY SPONSORED RESEARCH/DEVELOPMENT (Not Applicable)

BACKGROUND OF THE INVENTION

The present invention pertains generally to a cushioning system for an article worn or held by a user and, more particularly, to a uniquely configured massaging and reflexology system for an article of footwear, for a hand-held implement, or for use with other articles that may be placed into contact with the body. The massaging and reflexology system is specifically configured to provide the combined therapeutic benefits of shock absorption and reflexology to a user's feet, hands or other parts of the body while simultaneously providing the benefits of air circulation to remove perspiration and dissipate body heat as well as providing muscle stimulation and blood circulation.

There is currently known in the prior art, cushioned insoles for footwear to provide shock absorption to the feet. The cushioning features of these insoles serve to protect the feet, knees, and other joints from injury during walking and running. Configured as either permanently affixed to the sole on the inside of a shoe or separately insertable, certain insoles may be configured to additionally provide massaging features by incorporating projections into a top surface of the insole. These projections may promote blood circulation within the foot to improve the strength, stamina and endurance of the foot muscles, thereby increasing the overall health and comfort of the user. Improved blood circulation is especially important in demanding applications, such as athletics. The prior art includes several devices for shoe insoles, each one purporting to include features which improve the comfort and health of the wearer.

U.S. Pat. No. 4,934,071 discloses an insole with a top surface having a series of spaced, hollow humps. The humps have rounded top surfaces which bend laterally and deform elastically under pressure from the foot, returning to their original position when the pressure from the foot is reduced. Although the hollow humps provide a massaging effect to the user's foot, unless permanently mounted to the sole on the inside of the shoe, the insole may slide around in the shoe, creating the risk of blistering of the top and sides of the foot as it rubs against the shoe.

U.S. Pat. No. 4,670,995 discloses an air cushion for a shoe sole. The air cushion has at least one lateral cylindrical space or cavity of rectilinear cross-section for providing automatically adjustable cushioning by means of an air valve. The air valve is configured to allow for the introduction of shock absorbing fluid, such as a gas, into the cavity. The air valve also includes a means for bleeding a portion of the shock absorbing gas such that the gas pressure, and hence the shock absorbing characteristics of the shoe, may be tailored to match the physical characteristics of the user and to the type of activity in which the user may be engaged. Although the air cushion of the reference allows for the tuning and optimization of the shoe's cushioning characteristics, the air cushion suffers from the inability to provide massaging of the bottom of the feet during use. Furthermore, the air cushion of the reference fails to provide any means for circulating air within the insole to reduce the problem of perspiration and heat buildup within the shoe.

U.S. Pat. No. 5,896,680 discloses a three-dimensional textile fabric for use in footwear, and particularly for use in the insoles of athletic shoes. The textile fabric is constructed of a three-dimensional fiber network structure that is claimed to be of light weight, have improved breathability characteristics and the capability of being repeatedly flexed without a loss of cushioning properties. A multiplicity of projections may be included in the insole, the size, shape and rigidity of the projections varied along the length of the insole in order to enhance the cushioning properties of the insole. While the fiber network described in the reference is primarily directed at providing a material construction for producing a resilient and lightweight insole, the configuration does not include any massaging features in the configuration. Furthermore, due to the relatively large size of the projections, the user may experience physical strain and discomfort, especially at the ball of the foot because this area of the foot typically bears against the insole even while the foot is resting flat.

U.S. Pat. No. 6,430,843 discloses a fluid-filled bladder for use in the sole of an article of footwear. The bladder has a plurality of separate sealed cushioning chambers that are in fluid communication with each other. A control device is included to dynamically distribute and regulate the pressure of the fluid within the chambers based on sensor feedback as well as user input. A central processing unit (CPU) may also be included to regulate electronically-actuated, CPU-commanded valves that operate to control the flow of fluid amongst the chambers in order to optimize the performance of the cushioning system. Although the device in the reference features a high degree of controllability and is capable of being optimized for a particular wearer and activity, the combination of many chambers, valves, and the CPU necessarily translates into a highly complex system which is of high cost and has decreased reliability compared to passive cushioning systems. Moreover, such a device lacks any massaging and ventilation characteristics featured by simpler devices of the prior art.

U.S. Pat. No. 4,653,597 discloses an elastic air-sack insole configured to improve the recirculation of air within an article of footwear. Formed of an elastic film affixed to the edge of a flat insole, the air-sack insole automatically absorbs and exhausts air into and out of the footwear article such that the inside of the shoes are maintained in a dry and cool condition. Although the cushioning air-sack of the reference may be effective in providing enhanced air circulation inside the insole of the footwear article, such a device lacks the capability for circulating air underneath the user's foot because the air sack is sealed underneath the top surface of the insole. Furthermore, the referenced device lacks the capability for providing any massaging effect to the user's feet.

U.S. Pat. No. 6,219,941 discloses a foot massaging shoe insole having a base made of foam, a fabric material layer fused over the foam layer, and rounded pellets made of synthetic plastic arranged in clusters that are adhered to and spaced about the base for contacting the foot during use. The spatial arrangement of the clusters is described as forming air channels along which air can circulate in order to provide ventilation between the wearer's foot and the insole. Although the upper surfaces of the rounded pellets are intended to massage the foot with the foam base providing the benefit of cushioning, the localized placement of the clusters of pellets may inhibit the circulation of air along the length of the insole because the user's foot may block the flow of air where the foot locally contacts the base in the areas intermediate each of the clusters. Furthermore, unless permanently mounted to the sole of a shoe, the insole may slide around in the shoe causing blistering of the top and sides of the foot during walking or running.

U.S. Pat. No. 5,784,807 discloses a fluid filled support system for footwear having a plurality of fluid-filled bladders that are fluidly interconnected. The support system includes a support member that completely surrounds the foot to provide cushioning and support. As pressure is applied to the wearer's foot, the support member reacts by forcing the redistribution of entrapped fluid from areas of high pressure to areas of low pressure. Although the device of the reference provides a responsive cushioning system, such a system is complex and costly to manufacture. Furthermore, the device of the reference fails to provide any massaging features or air ventilation features.

U.S. Pat. No. 5,669,161 discloses a shock-absorbing cushion that may be utilized in an insole. Comprised of two sheets sealed together at the periphery and having a hollow interior, one sheet is flat or smooth while the other sheet includes a plurality of recesses which may be holes or grooves with vertical walls that tie the two sheets together to form a cubic supporting structure. The structure has a hollow interior filled with fluid or a semi-solid material to have an inherent supporting characteristic against pressure or shock. Although the shock-absorbing suction material may be widely applied to sporting goods such as leg or shin guards, shoulder pads, racket grips and the like, the structure includes no provisions for air circulation or massaging of the user's skin to improve blood circulation.

In addition to the devices mentioned above that are configured to improve the health and comfort of a user of footwear, one additional feature that may be included in such devices provides for the application of massage to certain zones on the sole of the foot. It is believed that massaging specific zones of the foot promotes the stimulation of specific organs. Reflexology, or acupressure, is a technique involving the application of localized stimulation to specific spots or nerve zones on the exterior of the human body, including the hands and feet, in order to stimulate internal organs and muscles that are believed to be connected to these nerve zones.

In addition, it is well known that applying localized pressure, or massaging, to specific areas of the soles of the feet results in relaxation of the body in general. Thus, it follows that a cushioning system including features for providing acupressure to specific zones of the feet with the additional benefit of air circulation and general massaging to stimulate blood flow may result in an improvement in the overall comfort and health of the wearer or user. Likewise, such a system may be adapted for use on the handle grip of a hand-held implement such that the combined therapeutic benefits of shock absorption, air circulation, massage and reflexology may also be provided to a user's hands. Furthermore, such a system may be adapted for use in other articles that are worn or that bear against the body such that the above-mentioned therapeutic benefits may be provided to other areas of the wearer or user's body.

Thus, there exists a need in the art for a system that can be used in footwear and other worn articles to provide the benefits of support and cushioning to protect the feet, knees, and other joints from injury due to repeated shock caused by the impact of footwear or other worn or used articles on hard surfaces. Additionally, there exists a need in the art for a system that can be used in footwear and other worn or used articles to provide the benefits of air circulation between the user's body and the article in order to remove perspiration and dissipate body heat. Also, there exists a need in the art for a system that can be used in footwear and other worn or used articles to simultaneously provide continuous massaging and stimulation of blood circulation in the feet, hands and other body surfaces. For an article of footwear and other articles configured to bear against the feet, such continuous massaging may be induced by the rhythmic application of pressure upon the bottom of the feet during walking or running.

SUMMARY OF THE INVENTION

The present invention specifically addresses and alleviates the above referenced deficiencies associated with shoe insoles or articles of footwear. More particularly, the present invention is a massaging and reflexology system as incorporated into a shoe insole in a first embodiment and a handle grip in a second embodiment although it is contemplated that the massaging and reflexology system may be adapted to a wide variety of applications including, but not limited to, neck and back braces, a conveyor track of a treadmill, seat cushions and back support cushions, hand grips for tennis rackets and other sporting implements, hand held stress balls, rolling massaging bars for feet and body, exercise mattresses, beach mats, bath tub mats, steering wheel covers, and rejuvenating insoles and foot support members for shoes or slippers.

The massaging and reflexology system is comprised of a core body defining opposing top and bottom surfaces, a plurality of cups disposed on the top surface, and a respective pressure nubs disposed within each one of the cups. Each cup defines a substantially concave surface projecting outwardly from the top surface. A respective bump or pressure nub is centrally disposed on the concave surface of each one of the cups. The cups provide a general cushioning and massaging benefit to the soles of the feet as the system flexes during use with the cups being alternately compressed during walking or running. The bumps or pressure nubs provide a reflexology or acupressure benefit to the soles of the feet due to the localized application of pressure against the soles of the feet. The core body may be configured in any number of shapes, sizes and configurations although the top surface and bottom surface of the core body may have a generally planar configuration. Additionally, the core body perimeter may be sized and trimmed to match the perimeter of a particular article of footwear.

The shoe insole may include a heel portion, a toe portion and an intermediate portion although any of the portions may be combined to form the core body. In addition, the shoe insole may comprise any one of the heel, intermediate, toe or arch portions alone. Furthermore, the shoe insole may comprise combinations of partial areas of any of the portions. For example, the shoe insole may comprise a heel portion and part of an intermediate portion and part of an arch portion. Alternatively, the shoe insole may comprise an arch portion and part of an intermediate portion.

The thickness of the core body may be varied along a length thereof. For example, the thickness of the core body may be greater at the heel portion than at the intermediate portion. The top surface of the core body may be contoured to match a bottom surface of a particular wearer's feet such that the arch of the wearer's feet may be supported by an increased thickness in the arch portion in order to correct for over-pronation or under-pronation during walking and running. The shoe insole may be removably detachable from the shoe such that one set of shoe insoles may be utilized in multiple articles of footwear for the same user.

The massaging and reflexology system in the first embodiment may further comprise a plurality of support webs projecting from the bottom surface of the shoe insole. The support webs may be orthogonally-arranged in a grid. The cup perimeters may be configured in a circular shape and diameters of the cups may vary along the length of the core body. Although the cup perimeters may be configured in any shape, size, or configuration, the cup perimeters may be elliptically shaped in order to provide enhanced gripping of the user's feet. The pressure nubs may be of relatively smaller size than the cup diameters and may be configured in any number of shapes and sizes.

For example, the pressure nubs may have a hemispherical shape. It is contemplated that the pressure nubs may be arranged in either a constant pattern throughout the shoe insole or in a varying arrangement along the shoe insole with a variety of shapes, sizes and configurations tailored to match the physical characteristics of the user and to the activity in which the user is engaged. It is also contemplated that the pressure nubs may be provided in only a discrete number of the cups. These cups having pressure nubs may be located strategically along the top surface so as to provide the benefits of acupressure to the soles of the feet.

The massaging and reflexology system may further comprise a plurality of cup spacers with a respective one of the cup spacers being formed between each one of the cups and the top surface. The cup spacers serve to extend the cups away from the top surface. By extending the cups away from the top surface, the massaging action of the cups and the pressure nubs may be enhanced. Furthermore the increase in spacing between the cup and the top surface may result in improved air circulation between the shoe insole and the bottom of a user's feet.

The cups may be disposed on the bottom surface of the shoe insole in order to provide a gripping force between the shoe insole and the shoe and to extend the spacers away from the bottom surface to improve air circulation between the inner surface of the sole of the shoe and the bottom surface of the shoe insole to improve heat dissipation of the shoe insole. Pressure nubs may be included within the cups of the bottom surface in order to increase the effectiveness of the pressure nubs of the top surface. In this arrangement, the cup of the bottom surface may be aligned in a back-to-back configuration with the cup of the top surface.

A second embodiment of the massaging and reflexology system is adapted for use in a hand-held implement having a shaft portion which forms a handle grip for the implement. The massaging and reflexology system of the second embodiment is comprised of the core body defining an inner surface and an outer surface with the plurality of cups being disposed on the outer surface. A plurality of cup spacers may be provided for spacing the cups away from the outer surface. The plurality of pressure nubs is disposed within the cups. In the second embodiment, the core body is sized and configured to circumscribe the handle grip of the shaft portion of the implement. Each one the cups defines the concave surface which projects outwardly from the outer surface. A respective one of the cup spacers may be formed between each one of the cups and the outer surface. The cup spacers may be sized to provide a predetermined spacing of the cups from the outer surface and may be tailored to the activity in which the handle grip may be used.

The core body, the cups, the cup spacers and the pressure nubs may be formed as a unitary structure of resilient, elastomeric material such as silicone gel or polyurethane, although many other materials may be workable. The core body may be adapted to accept cups and/or cup spacers within receiving apertures that are pre-formed within the core body. Furthermore, the core body, the cups, the cup spacers and the pressure nubs may each be formed of different materials having differing densities, resiliencies and durability characteristics. The density of the core body and densities of the cups may vary along the length of the core body. The core body of the shoe insole of the first embodiment may be formed of silicone gel or closed cell foam while the cup spacers and cups may be formed of silicone gel or polyurethane with the pressure nubs being formed of a higher density material such as poly vinyl chloride (PVC) or plastic.

Regarding the operation of the first embodiment of the shoe insole, during walking or running, the cups are alternately compressed and extended back to their original shape during sequential application of pressure as the foot is translated from the heel portion to the toe portion. The cups flatten outward as pressure is applied, providing a spring-like effect against the impact of the article of footwear against the walking or running surface. The core body provides additional cushioning and shock absorption. The pressure nub, having a reduced contacting surface area upon the foot relative to the larger contact area of the cup, essentially applies a point load to the sole of the foot.

In this manner, the pressure nubs may exhibit acupressure or reflexology characteristics wherein the nerve endings in the foot may be stimulated. Under reflexology theory, these stimulated nerve endings communicate with specific organs of the body via nerve connections to stimulate the organ. Due to the spacing of the cups away from the top surface, improved air circulation may occur as internal air is exchanged with external air during the rhythmic application of pressure upon the cups to improve the dissipation of heat and allow for the removal of perspiration from the user's foot.

Regarding the operation of the second embodiment of the handle grip of an implement, the cups are alternately compressed and extended back to their original shape during the application of pressure as the hand squeezes the handle grip. As pressure is applied, the cup flattens outward providing a spring-like effect. The core body provides additional cushioning and shock absorption due to its resilient properties.

The pressure nub then applies a point load to nerve endings in specific areas of the hand, with the stimulation being transmitted to specific organs via nerve connections to stimulate organs connected to the nerve endings in the hand. The spacing of the cups from the outer surface provides improved air circulation to the hand which may reduce slippage caused by perspiration. Such improved air circulation may additionally improve the dissipation of heat from the handle grip.

BRIEF DESCRIPTION OF THE DRAWINGS

These as well as other features of the present invention will become more apparent upon reference to the drawings wherein.

DETAILED DESCRIPTION OF THE INVENTION

Figure 1:
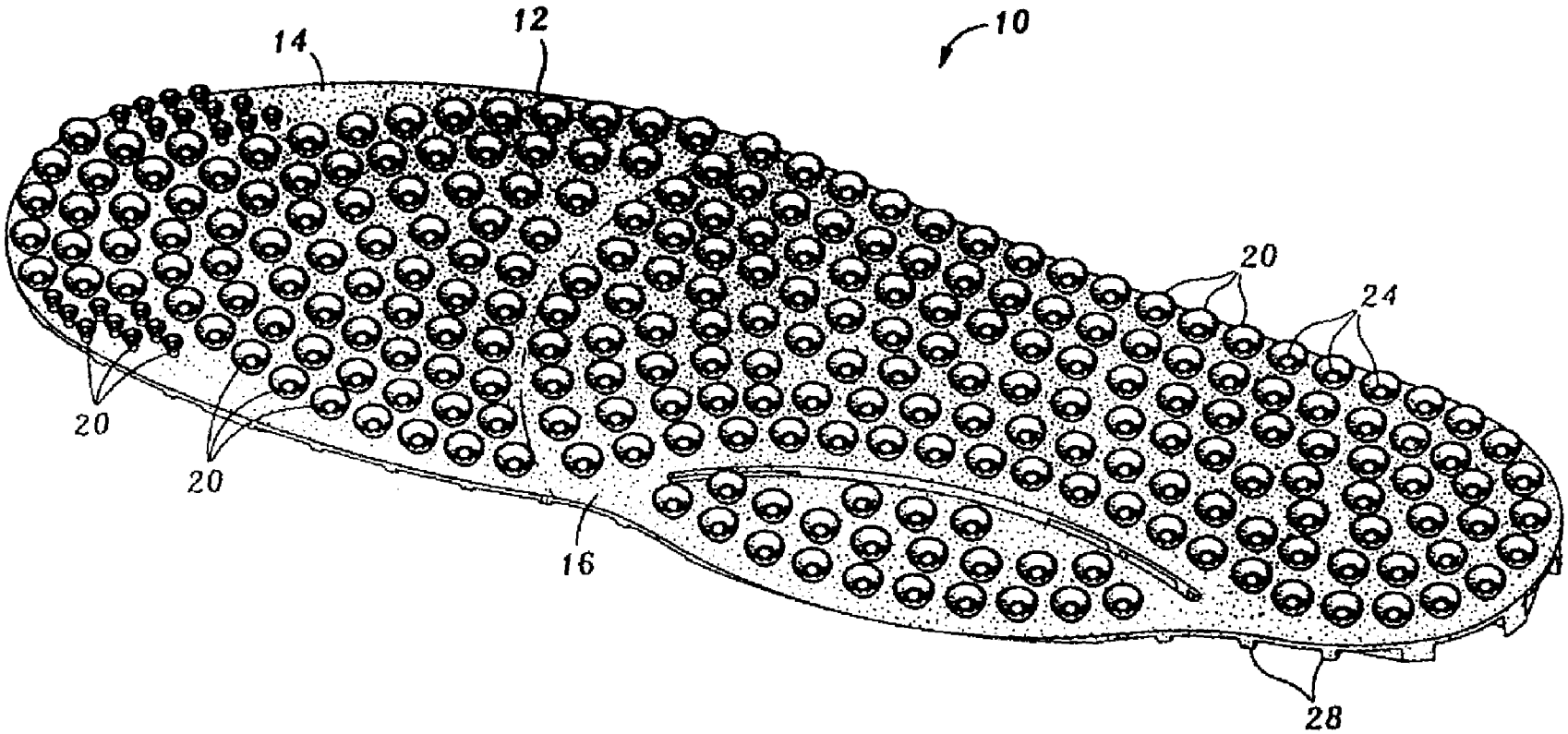
FIG. 1 is a perspective view of a massaging and reflexology system as incorporated into a shoe insole in accordance with a first embodiment of the present invention.

Referring now to the drawings wherein the showings are for purposes of illustrating preferred embodiments of the present invention and not for purposes of limiting the same, FIG. 1 is a perspective view of a massaging and reflexology system 10 as incorporated into a shoe insole 12 in accordance with a first embodiment of the present invention. Although the massaging and reflexology system 10 of the present invention is disclosed according to its incorporation into a shoe insole 12, the massaging and reflexology system 10 is also adaptable for use in hand-held implements 36 in a second embodiment. The hand-held implements 36 of the second embodiment may include items such as golf clubs and tennis rackets.

The massaging and reflexology system 10 is adapted for use in a handle grip 40 of various items as will be discussed in more detail below. In this regard, it is contemplated that the massaging and reflexology system 10 may be adapted to a wide variety of applications including, but not limited to, neck and back braces, a conveyor track of a treadmill, seat cushions and back support cushions, hand grips for tennis rackets and other sporting implements, hand held stress balls, rolling massaging bars for feet and body, exercise mattresses, beach mats, bath tub mats, steering wheel covers, and rejuvenating insoles and foot support members for shoes, slippers and other articles of footwear.

Figure 2:
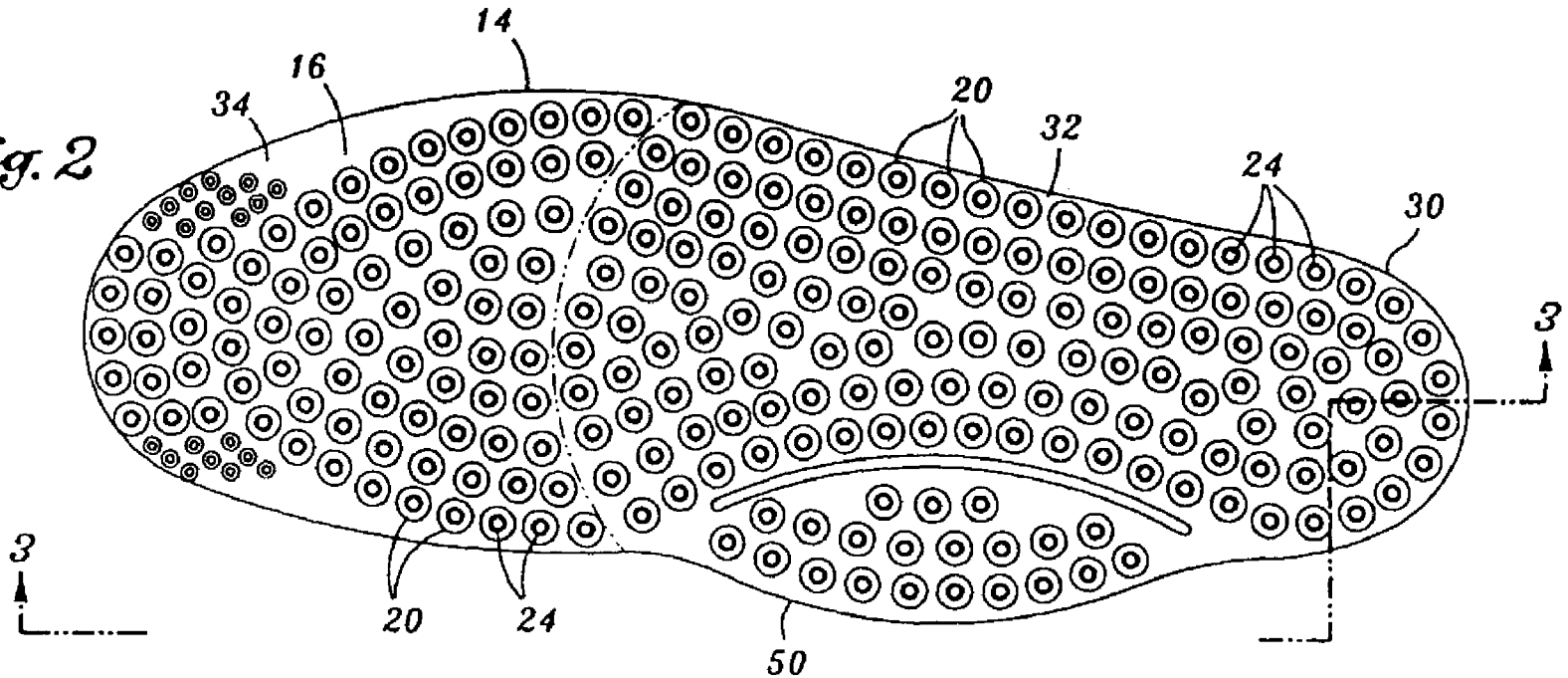
FIG. 2 is a plan view illustrating the arrangement of a plurality of cups disposed on a top surface of the shoe insole of the first embodiment.

In FIG. 1, shown is the massaging and reflexology system 10 as incorporated into the shoe insole 12 in the first embodiment. FIG. 2 is a plan view illustrating the arrangement of a plurality of cups 20 disposed on a top surface 16 of the shoe insole 12. The massaging and reflexology system 10 is comprised of a core body 14 defining opposing top and bottom surfaces 16, 18, and a plurality of cups 20 disposed on the top surface 16. Optionally, bumps or pressure nubs 24 may be disposed within each one of the cups 20. According to one embodiment, the top surface 16 is disposable in a direction facing toward a user, while the bottom surface 18 is disposable in a direction facing away from the user.

As can be seen in FIG. 2, each cup 20 defines a substantially concave surface 22 projecting outwardly from the top surface 16. The respective bump or pressure nub 24 is centrally disposed on the concave surface 22 of each one of the cups 20. As will be discussed in more detail below, the cups 20 provide a general cushioning and massaging benefit to the soles of the feet during use as the cups 20 are compressed during walking or running. The pressure nubs 24 provide a reflexology or acupressure benefit to the soles of the feet due to the localized application of pressure against the soles of the feet.

Although shown as generally configured in the shape of the shoe insole 12 in FIGS. 1 and 2, the core body 14 may be configured in any number of shapes, sizes and configurations, as will be described in greater detail below. The top surface 16 and bottom surface 18 of the core body 14 may have a generally planar configuration. Optionally, the top surface 16 may be contoured to generally match the contour of a human foot such that the massaging and reflexology system 10 is maintained in substantially continuous contact with at least a portion of the bottom of the wearer or user's foot. In this manner, the interactive effects of massaging, shock absorption, muscle stimulation and blood circulation may be better administered to the wearer or user's foot.

Advantageously, the bottom surface 18 may be planar such that it may match the generally planar configuration of an inner sole of an article of footwear. Additionally, the core body 14 perimeter may be formed, sized and/or trimmed to match a perimeter of a particular article of footwear. By shaping the core body 14 in this manner, the perimeter of the core body 14 may bear against walls of the article of footwear in order to prevent side-to-side motion or forward-aft motion relative to the shoe or article of footwear in which the core body 14 is used.

Figure 13:
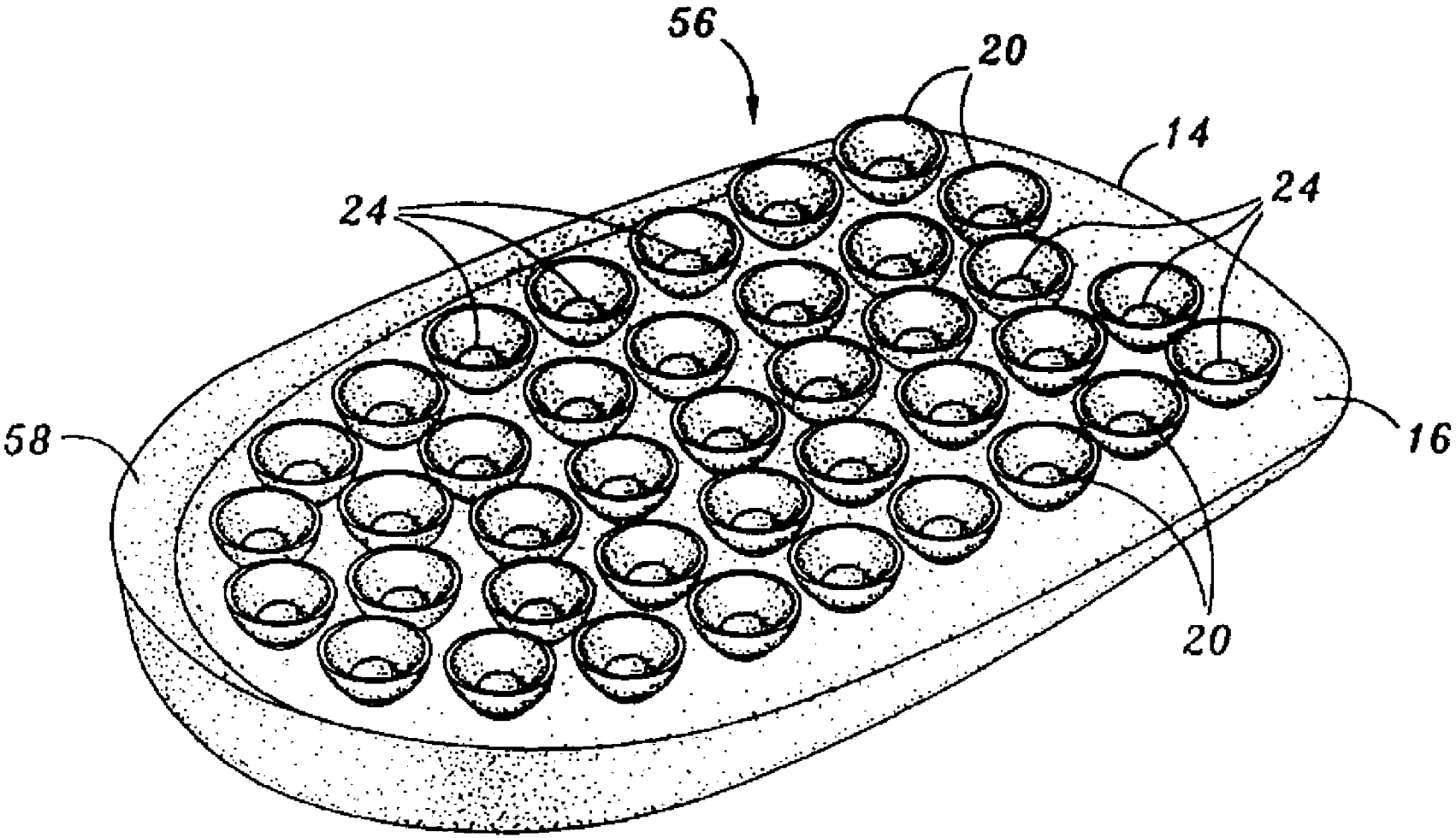
FIG. 13 is a perspective view of a heel pad configured for use in an article of footwear.

The perimeter of the core body 14 may also be curved or bent upwardly such that a portion of the bottom surface 18 of the core body 14 may bear against the walls of the shoe, further inhibiting relative motion within the article of footwear. Toward this end, a heel pad 56 is shown in FIG. 13 and includes an edge flange 58 extending upwardly from the top surface 16 of at least a portion of the core body 14 perimeter. An inner surface of the edge flange 58 of the heel pad 56 is preferably sized and configured to generally match a heel contour of a human foot to prevent relative side-to-side motion between the heel pad 56 and the heel.

An outer surface of the edge flange 58 is also preferably sized and configured to match an inner surface of an article of footwear to prevent relative side-to-side motion therebetween. The first embodiment of the massaging and reflexology system 10 may be configured in a manner similar to the heel pad 56 wherein the first embodiment includes an edge flange 58 extending upwardly from the top surface 16 of at least a portion of the core body 14 perimeter with the edge flange 58 inner surface being configured to generally match a heel of a human foot and the edge flange 58 outer surface being configured to match an inner surface of an article of footwear Although shown in FIGS. 1 and 2 as configured in the shape of a shoe insole 12 having a heel portion 30, a toe portion 34 and an intermediate portion 32, the core body 14 may be generally configured in the shape of only a heel portion 30 such as the heel pad 56 illustrated in FIG. 13. Referring to FIG. 2, an arch portion 50 may be seen disposed within the intermediate portion 32. It is contemplated that an intermediate portion 32 may further be combined with the heel portion 30. However, in this regard, any portion of the shoe insole 12 may be combined to form the shape of the core body 14.

Figure 3:
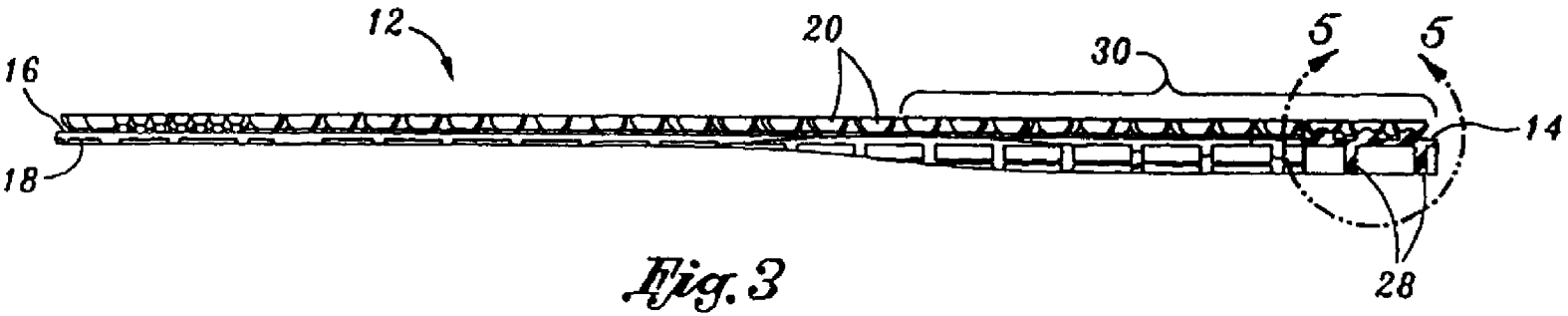
FIG. 3 is a sectional view taken along line 3-3 of FIG. 2 illustrating the arrangement of the cups on the top surface in a heel portion, an intermediate portion and a toe portion of the shoe insole.

Turning now to FIG. 3, shown is a sectional view taken along line 3-3 of FIG. 2 illustrating the arrangement of the cups 20 on the top surface 16 in the heel portion 30, the intermediate portion 32 and the toe portion 34 of the shoe insole 12. As can be seen, the thickness of the core body 14 may be varied along a length thereof. For example, the thickness of the core body 14 may be greater at the heel portion 30 than at the intermediate portion 32, as is illustrated in FIG. 3. For configurations having an arch portion, the thickness of the core body 14 may be greater at the heel portion 30 and arch portion than at the intermediate and toe portions 32, 34.

Alternatively, the thickness of the core body 14 at the heel portion 30 may be sized to be greater than the thickness of the core body 14 at both the intermediate and toe portions 32, 34. In addition, the thickness of the core body 14 at the arch portion may be sized to be greater than the thickness of the core body 14 at the heel portion 30. In addition, the top surface 16 of the core body 14 may be contoured to match a bottom surface of a particular wearer or user's feet such that the arch of the wearer or user's feet may be supported by the arch portion in order to correct for over-pronation or under-pronation during walking and running. The core body 14 of the heel pad 56 shown in FIG. 13 may be configured and contoured in a manner similar to that described above for the core body 14 of the shoe insole 12 shown in FIGS. 1-3.

The top surface 16 of the heel portion 30 of the shoe insole 12 may be contoured in order to cradle and support the heel to provide a high degree of lateral stability for demanding sporting activities such as tennis, basketball and football. The shoe insole 12 may be permanently affixed to a sole on the inside of a shoe. Alternatively, the shoe insole 12 may be removably detachable from the shoe such that one set of shoe insoles 12 may be utilized in multiple articles of footwear for the same wearer or user. As may be appreciated, there are an infinite number of configurations for the shoe insole 12 in which the thickness of the core body 14 may be sized and contoured.

Figure 4:
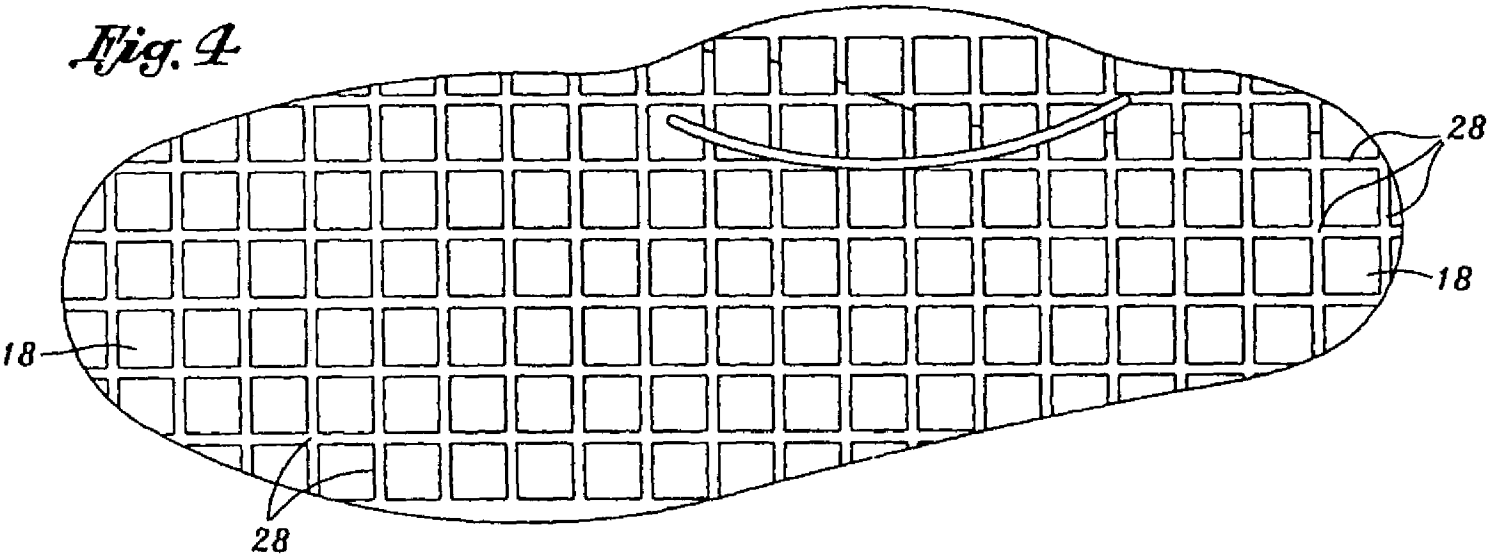
FIG. 4 is a plan view taken along line 4-4 of FIG. 3 illustrating support webs projecting from a bottom surface of the shoe insole.
Figure 5:
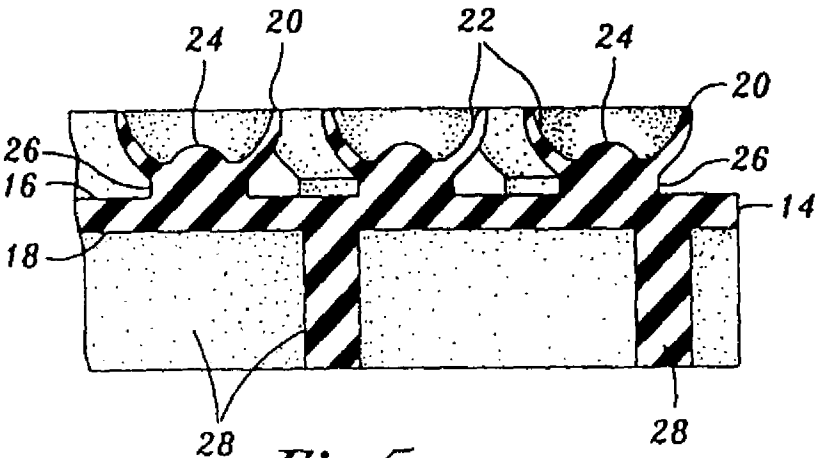
FIG. 5 is an enlarged sectional view taken along line 5-5 of FIG. 3 illustrating concave surfaces of the cups and pressure nubs disposed on the concave surfaces.

Turning now to FIGS. 4 and 5, shown is the massaging and reflexology system 10 further comprising a plurality of support webs 28 Shown in FIG. 4 is a plan view taken along line 4-4 of FIG. 3 illustrating the support webs 28 projecting from the bottom surface 18 of the shoe insole 12. Shown in FIG. 5 is an enlarged sectional view taken along line 5-5 of FIG. 3 illustrating the support webs 28 as well as the concave surfaces 22 of the cups 20 and the pressure nubs 24 disposed on the concave surfaces 22. The support webs 28 may be configured in a grid of orthogonally-arranged members extending perpendicularly from and disposed along the bottom surface 18. However, the support webs 28 may be disposed in any angular orientation with respect to adjacent support webs 28 as well as with respect to the bottom surface 18.

Referring still to FIGS. 4 and 5, the support webs 28 may extend downwardly from the bottom surface 18 at varying thicknesses along the length of the shoe insole 12 such that the overall thickness of the shoe insole 12 may be varied along the length thereof in a manner similar to the variable thickness of the core body 14. For example, by increasing the extension of the support webs 28 at the heel portion 30 relative to the remainder of the shoe insole 12, the wearer or user's feet may be disposed at a slight forward-leaning angle to improve the fit and comfort of a shoe. It is contemplated that the bottom surface 18 may be configured with a plurality of holes or depressions spaced therealong in order to promote breathability of the area between the bottom surface 18 and the sole of the shoe, Referring now more particularly to FIG. 5, shown in more detail are the cups 20 disposed on the top surface 16 with each cup 20 defining the substantially concave surface 22 projecting outwardly from the top surface 16. Importantly, the pressure nub 24 is included within each cup 20 that is disposed on the top surface 16 of the shoe insole 12. The pressure nub 24 may be centrally disposed on the concave surface 22 of each one of the cups 20. As will be discussed in more detail below, the cups 20 provide a general cushioning and shock absorbing benefit to the soles of the feet as the cups 20 are alternately compressed and extended during walking or running. Additionally, the pressure nubs 24 provide a reflexology or acupressure benefit to the wearer's feet due to the localized application of pressure by each pressure nub 24 against the soles of the feet to stimulate the nerve endings in these localized areas.

The cup 20 perimeters may be configured in a generally circular shape. Diameters of the cups 20 may vary along the length of the core body 14. The diameters of the cups 20 may be substantially equal along the length of the core body 14. Likewise, for the heel pad 56 shown in FIG. 13, the diameters of the cups 20 may vary along the length of the heel pad 56. Alternatively, the diameters of the heel pad 56 may be substantially equal along the length of the core body 14. As will be appreciated, there are an infinite number of shapes, sizes and relative spacings that may be utilized for the cups 20. For example, the cups 20 may be elliptically configured in order to enhance the gripping characteristics between the user's foot and the shoe insole 12 in order to prevent forward-aft motion of the foot during walking or running. Regarding the geometric arrangement or spacing of the cups 20 along the core body 14, it is contemplated that the cups 20 may be positioned at equidistantly spaced intervals. optionally, the cups 20 may be arranged at intervals of varying spacing along the core body 14. The cups 20 may also be arranged such that cups 20 of larger diameter are generally located in the heel portion 30 with a size of the cups 20 generally decreasing along the core body 14 toward the toe portion 34.

The cup 20 perimeters may further be configured with a series of notches disposed therearound and generally resembling serrations to enhance the massaging and blood circulation and muscle stimulation characteristics of the cups 20 as they rhythmically contact the bottom of the wearer or user's feet during use. The cup 20 perimeters may be axially parted from the perimeter down to the pressure nub 24 to form a plurality of flaps which alternately flatten with pressure during walking to provide enhanced massaging characteristics against the foot. Furthermore, the cross-section of the flaps may be variable along the length of each flap in order to provide a mild frictional massaging action between the flaps and the bottom of the wearer or user's foot.

The pressure nubs 24 may be of relatively smaller size than the cup 20 diameters and may be configured in any number of shapes and sizes. For example, the pressure nubs 24 may have a hemispherical shape. Furthermore, the pressure nubs 24 may have a generally rounded, spherical or ovoidal shape.

Alternatively, the pressure nubs 24 may have a truncated conical shape with a rounded tip in order to provide optimal acupressure stimulation of the user's feet. In this regard, it is contemplated that the pressure nubs 24 may be arranged in either a constant pattern throughout the shoe insole 12 or in a varying arrangement along the shoe insole 12 with a variety of shapes, sizes and configurations tailored to match the physical characteristics of the user and to the activity in which the shoe insole 12 is worn.

It is also contemplated that the pressure nubs 24 may be provided in only a discrete number of the cups 20. Cups 20 having pressure nubs 24 may be located strategically along the top surface 16 so as to provide the benefits of acupressure to the soles of the feet according to reflexology charts, wherein specific zones of the feet are believed to be connected via nerves to specific organs and muscles in the body. For example, pressure nubs 24 may be omitted in the toe potions of the shoe insole 12 and may be included only in the intermediate portions 32 of the shoe insole 12. It is believed that certain areas of the foot contain nerve endings that are connected to the liver, such that stimulation of the intermediate portion 32 of the feet may ultimately stimulate the liver.

As can also be seen in FIGS. 1 and 5, the massaging and reflexology system 10 may further comprise a plurality of cup spacers 26 with a respective one of the cup spacers 26 being formed between each one of the cups 20 and the top surface 16. The cup spacers 26 serve to extend the cups 20 away from the top surface 16. By extending the cups 20 away from the top surface 16, the massaging action of the cups 20 and the pressure nubs 24 may be enhanced due to increased local application of pressure provided by the relatively smaller support area of the cup spacers 26 as compared to an arrangement wherein the cups 20 are directly affixed to the top surface 16.

Furthermore the increase in spacing between the cup 20 and the top surface 16 may result in improved air circulation between the shoe insole 12 and the bottom of a user's feet. Such improved air circulation occurs by the exchange of internal air with external air during the alternating application of pressure upon the cups 20. Such improved air circulation may improve the dissipation of heat and allow for the removal of perspiration from the user's foot. The cup spacers 26 may be configured as elongate cylinders as shown in FIGS. 1 and 5. However, it is contemplated that the cup spacers 26 may be configured in a variety of shapes, sizes and configurations.

Figure 6:
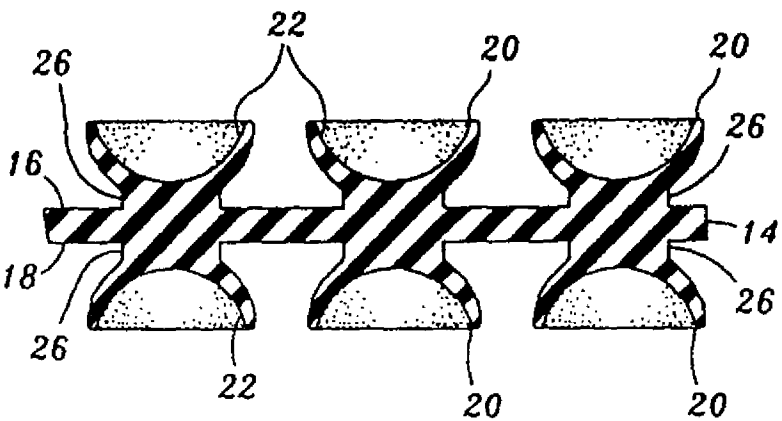
FIG. 6 is an enlarged sectional view of the shoe insole illustrating an arrangement wherein a plurality of cups are disposed on the top and bottom surfaces of the shoe insole.
Figure 6A:
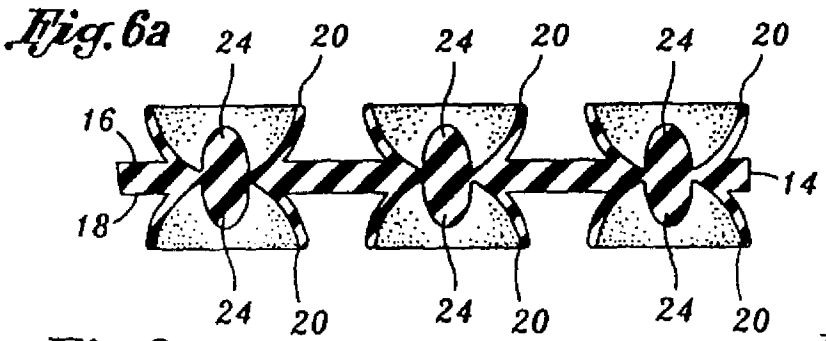
FIG. 6*a* is an enlarged sectional view of the shoe insole illustrating an arrangement wherein the pressure nubs are included within each one of the cups.

Turning now to FIGS. 6 and 6*a*, shown are enlarged sectional views of the shoe insole 12 illustrating an arrangement wherein the cups 20 are disposed on the bottom surface 18 of the shoe insole 12. In this arrangement, the cups 20 may provide a gripping force between the shoe insole 12 and the shoe, thus preventing relative motion therebetween. Such gripping force may aid in the support and stability of the foot within the shoe such that the risk of injury to the wearer may be reduced, particularly when the shoe insoles 12 are worn in demanding activities such as sporting events.

FIG. 6 illustrates an arrangement of the shoe insole 12 wherein a plurality of the cups 20 are disposed on the top and bottom surfaces 16, 18 of the shoe insole 12 with the pressure nubs 24 being omitted from each one of the cups 20. FIG. 6*a* is an enlarged sectional view of the shoe insole 12 illustrating an arrangement wherein a pair of opposing ones of the pressure nubs 24 are included within each one of the cups 20.

Importantly, in FIG. 6*a*, the shoe insole 12 includes a thinned section of the core body 14 being interposed between the opposing ones of the pressure nubs 24 as compared to the section between the cups 20 in FIG. 6 wherein the shoe insole 12 has a thicker section between the pressure nubs 24. Such thinned section between the pressure nubs 24 of FIG. 6*a* may impart a vibrational effect during the rhythmic compression of the shoe insole 12 as may occur during walking or running. The thinned section of the core body 14 around the cup 20 allows for more rapid flexing and retracting of the cup 20 than that which may be obtained by a non-thinned section.

During the compression of the cup 20 shown in FIG. 6*a*, the cup 20 wall flattens outwardly due to foot motion and foot pressure. The pressure nubs 24 are then briefly forced downwardly under the foot pressure. After the foot pressure is released as the foot rolls upwardly away from the cup 20, the pressure nub 24 retracts while the cup 20 moves back to its original position from the flattened position. In this manner, the opposing ones of the pressure nubs 24 may vibrate with minimal attenuation of the vibratory motion being provided by the thinned section.

Cup spacers 26 may be provided between the cup 20 and the bottom surface 18 in order to extend the cup 20 away from the bottom surface 18. By extending the cups 20 away from the bottom surface 18, the gripping or suction force of the cups 20 may be enhanced due to a more localized application of pressure upon the cups 20 during compression thereof as compared to an arrangement wherein the cups 20 are directly affixed to the bottom surface 18. Furthermore, by including cup spacers 26 between the cups 20 and the bottom surface 18, air circulation may be improved due to the increase in area between the surface of the sole of the shoe and the bottom surface 18 of the shoe insole 12.

Such improved air circulation, wherein external air may be exchanged with internal air, may improve heat dissipation of the shoe insole 12, improving the comfort of the wearer by maintaining the shoes in a cool, dry condition. Although it is contemplated that the cup spacers 26 of the bottom surface 18 may be configured as an elongate cylinder as shown in FIGS. 1, 5 and 6, it will be recognized that there are many shapes and configurations of the cup spacers 26 that may be workable. Pressure nubs 24 may be included within the cups 20 of the bottom surface 18 in order to increase the effect of the pressure nubs 24 of the top surface 16.

By aligning the cups 20 on the top surface 16 with the cups 20 on the bottom surface 18 in a back-to-back arrangement, the pressure nubs 24 of the bottom cups 20 may transmit a greater amount of pressure to the pressure nubs 24 of the top cup 20, as shown in FIG. 6*a*. Optionally, the shoe insole 12 may be configured such that the pressure nubs 24 are altogether omitted from the cups 20, as is shown in FIG. 6. In either case, the user's feet may experience increased stimulation due to the interactive effects of the cups 20 thereagainst.

It should be noted that the cups 20 may be included only on the top surface 16 of the shoe insole 12. Alternatively, cups 20 may be included only on the bottom surface 18 of the shoe insole 12. However, cups 20 may be included on both the top and bottom surfaces 16, 18 of the shoe insole 12, as was previously discussed. Pressure nubs 24 may or may not be included with the cups 20 depending on the particular application. The bottom surface 18 of the shoe insole 12 may be devoid of cups 20 and pressure nubs 24. However, it is contemplated that depressions or air pockets (not shown) may be formed in the bottom surface 18 of the shoe insole 12 in order to provide additional reflexology effect of the cup 20 and/or pressure nub 24 when compressed.

Such air pockets may be generally axially aligned with the cups 20 and/or pressure nubs 24. When foot pressure is applied to the shoe insole 12, each of the pressure nubs 24, if included, will flex and retract at a greater amount due to the action of the air pocket. In addition, the cups 20 on the top surface 16 of the shoe insole 12 may flex and flatten to a greater degree such that the benefits of massaging, muscle stimulation, blood circulation, cushioning, and softness characteristics may be enhanced.

Figure 8:
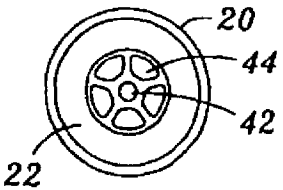
FIG. 8 is a plan view taken along line 8-8 of FIG. 7 illustrating the arrangement of the protuberance and the arched fingers in the first alternative embodiment of the pressure nub.
Figure 7:
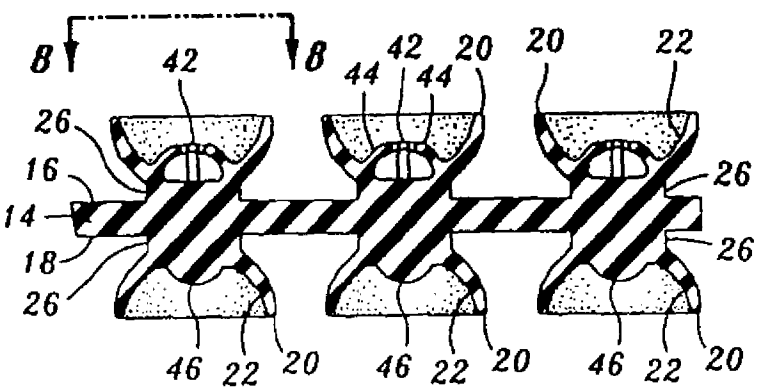
FIG. 7 is an enlarged section view of the shoe insole illustrating a protuberance projecting from the concave surface and surrounded by arched fingers in a first alternative embodiment of the pressure nub.

Turning now to FIG. 7, shown is an enlarged section view of the shoe insole 12 illustrating a protuberance 42 projecting from the concave surface 22 and surrounded by arched fingers 44 in a first alternative embodiment of the pressure nub 24. In FIG. 8, shown is a plan view taken along line 8-8 of FIG. 7 illustrating the arrangement of the protuberance 42 and the arched fingers 44 in the first alternative embodiment of the pressure nub 24. As can be seen in FIGS. 7 and 8, the elongate protuberance 42 projects upwardly from and is centrally disposed within the concave surface 22 of the cup 20. The arched fingers 44 are radially spaced about and extend upwardly from the concave surface 22 toward the protuberance 42. The arched fingers 44 are configured to provide increased flexing and spring-like action against the foot. It is contemplated that the arrangement of the protuberance 42 and the arched fingers 44 may be utilized in the cups 20 on the top surface 16.

Within the cups 20 on the bottom surface 18 which are aligned with the cups 20 on the top surface 16, a bump 46 may be centrally disposed therein to provide further resistance when the protuberance 42 and the arched fingers 44 of the cup 20 of the top surface 16 are compressed. It is also contemplated that the perimeter of the bottom cup 20 may include holes spaced therearound to allow trapped air to escape, thereby improving flexing of the bottom cup 20 as it flattens under pressure. In other alternative embodiments of the pressure nub 24, it is contemplated that a plurality of radially spaced loops may project outwardly from a central bump 46, the loops rejoining the concave surface 22 of the cup 20 at a point approximately midway between the cup 20 perimeter and the central bump 46.

Also, it is contemplated that the cup 20 may be omitted altogether in a further alternative embodiment, with the loop and the central bump 46 being affixed directly to the core body 14. Additionally, it is contemplated that the loops may be replaced by a plurality of radially-spaced projections surrounding the central bump 46, the projections and bump 46 being directly affixed to the core body 14. The projections may be arranged in any number of shapes, sizes and configurations in order to provide varying degrees of massaging and reflexology stimulation.

Figure 10:
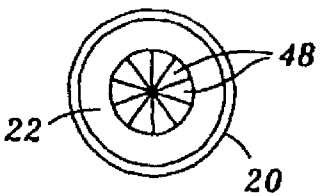
FIG. 10 is a plan view taken along line 10-10 of FIG. 9 illustrating the arrangement of the bump with the wedges in the second alternative embodiment of the pressure nub.
Figure 9:
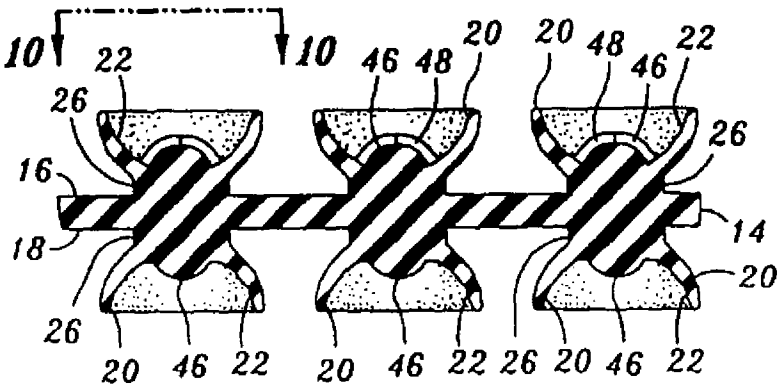
FIG. 9 is an enlarged section view of the shoe insole illustrating a hemispherical bump with wedges covering the hemispherical bump in a second alternative embodiment of the pressure nub.

Turning to FIGS. 9 and 10, shown is a second alternative embodiment of the pressure nub 24. In FIG. 9, shown is an enlarged section view of the shoe insole 12 illustrating a hemispherical bump 46 with radially spaced wedges 48 disposed over the top surface 16 of the bump 46. In FIG. 10, shown is a plan view taken along line 10-10 of FIG. 9 illustrating the arrangement of the bump 46 and the wedges 48. As can be seen, the bump 46 comprises a solid element, centrally disposed within the concave surface 22 of the cup 20 of the top surface 16. Although shown in FIG. 10 as arranged in a pattern of ten pie-shaped wedges 48, it is contemplated that any number of wedges 48 may be utilized.

The wedges 48 provide massaging action against the foot bottom as they bear against the bump 46 during compression. Similar to the first alternative embodiment of the pressure nubs 24, the second alternative embodiment of the pressure nub 24 may be disposed in a cup 20 of the top surface 16 in a back-to-back arrangement with the cup 20 on the bottom surface 18. The cup 20 of the bottom surface 18 may likewise include a centrally-disposed bump 46 configured to provide additional resistance when compression forces are applied to the wedges 48 and the bump 46.

Furthermore, the massaging and reflexology system 10 may be arranged in a further configuration (not shown) including a lower one of the cups 20 that is mounted back-to-back with an upper one of the cups 20 and wherein a perimeter edge of the lower cup 20 is affixed to or formed with the core body 14. Pressure nubs 24 may or may not be included within each one of the cups 20 depending on the application in which the system 10 is to be used. An edge flange 58 may also be included along a portion of the shoe insole 12 such as adjacent the heel portion 30. Such edge flange 58 may be configured as was described above for the heel pad 56 shown in FIG. 13. In such a configuration, both the top and bottom surfaces 16, 16 of the core body 14 are attached to the lower one of the cups 20 with a recess (not shown) being formed on the top surface 16 around the lower one of the cups 20. Such recesses may impart added reflexive capability and massaging characteristics to the shoe insole 12.

It is contemplated that the toe portion 34 and/or intermediate portion 32 of the shoe insole 12 may provide improved cushioning to highly stressed areas such as a ball area of a human foot. The degree to which the core body 14 is recessed may be adjusted depending on the particular effect desired. In the case of a shoe insole 12, the bottom surface 18 of the core body 14 is disposed against an inner surface of an article of footwear. In the case of a hand-held implement 36, the inner surface 52 of the core body 14 is disposed against an outer surface of the shaft portion 38 upon which the massaging and reflexology system 10 is to be mounted. In other applications such as an exercise mat, a bottom surface 18 of the core body 14 may be disposed against a floor such as a wooden floor.

Figure 11:
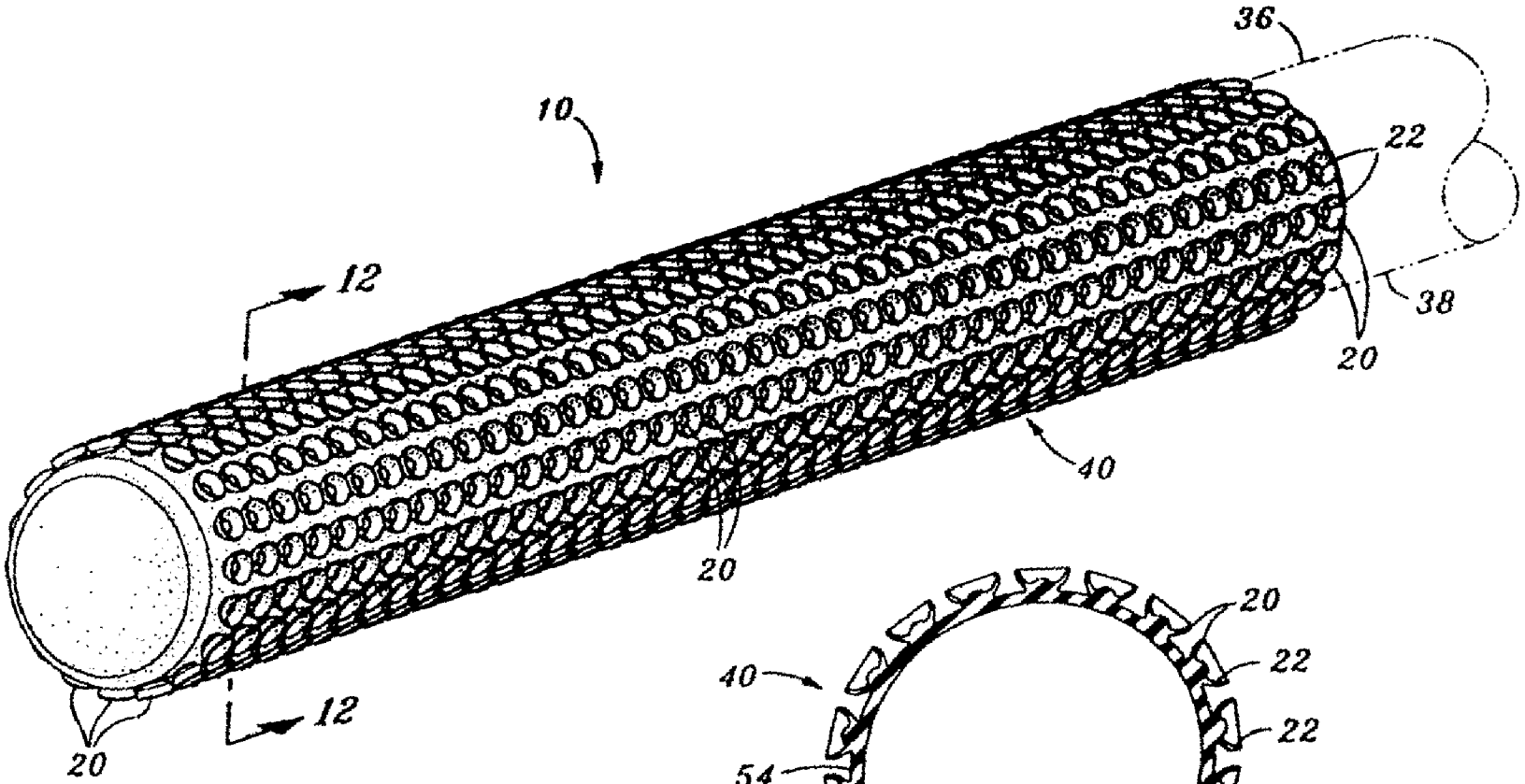
FIG. 11 is a perspective view of a massaging and reflexology system as incorporated into a hand-held implement in accordance with a second embodiment of the present invention.

A second embodiment of the massaging and reflexology system 10 adapted for use in hand-held implements 36 will now be described. In FIG. 11, shown is a perspective view of the massaging and reflexology system 10 as incorporated into the hand-held implement 36. As was earlier mentioned, the hand-held implement 36 may include hand grips for tennis rackets, golf clubs and other sporting implements, hand held stress balls, rolling massaging bars for feet and body, and steering wheel covers. However, it is contemplated that the massaging and reflexology system 10 may be incorporated into any device that is applied to or that may bear against the wearer or user's body.

Figure 12:
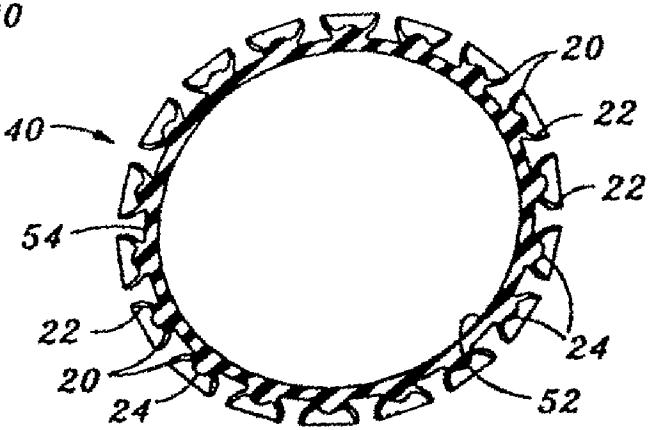
FIG. 12 is a sectional view taken along line 12-12 of FIG. 11 illustrating the arrangement of the cups on the outer surface of the second embodiment.

In FIG. 12, a sectional view taken along line 12-12 of FIG. 11 illustrates the arrangement of the cups 20 on the outer surface 54 of the second embodiment. As can be seen in FIG. 10, the implement 36 includes a shaft portion 38 which forms the handle grip 40 for the implement 36. The shaft portion 38 may be partially comprised of silicone gel or similar resilient or elastomeric material within any portion of the shaft portion 38. In this regard, the silicone gel may be disposed adjacent the inner surface 52 of the handle grip 40. The silicone gel may be disposed throughout a cross section of the shaft portion 38 such as for a massaging bar. A similar arrangement may be applied to a hand stress ball.

As in the first embodiment, the massaging and reflexology system 10 of the second embodiment is comprised of the core body 14 defining the inner surface 52 and the outer surface 54 with the plurality of cups 20 being disposed on the outer surface 54. A plurality of cup spacers 26 may be provided for spacing the cups 20 away from the outer surface 54. A pressure nub 24 may optionally be disposed within each one of the cups 20. In the second embodiment, the core body 14 is sized and configured to circumscribe the handle grip 40 of the shaft portion 38 of the implement 36. Although shown as being disposed on an end of the shaft portion 38, it is contemplated that the massaging and reflexology system 10 may be disposed on any area of the shaft portion 38 of the implement 36.

For example, the massaging and reflexology system 10 may be disposed in discrete, localized areas of an automobile steering wheel.

As was earlier mentioned, each one the cups 20 of the massaging and reflexology system 10 of the second embodiment defines the substantially concave surface 22 which projects outwardly from the outer surface 54. A respective one of the cup spacers 26 may be formed between each one of the cups 20 and the outer surface 54, as shown in FIG. 12. The cup spacers 26 may be sized to provide a predetermined spacing of the cups 20 from the outer surface 54 according to the activity in which the handle grip 40 may be used.

For example, it may be desirable to space the cups 20 at a greater distance away from the outer surface 54 in the handle grip 40 of a tennis racket as compared to a lesser spacing in a golf club due to the substantially continuously occurring contact between the hand and the handle grip 40 of a tennis racket as compared to relatively brief periods of contact that occurs between the hand and the handle grip 40 of a golf club. In this regard, it is contemplated that a greater amount of air circulation may be required in certain handle grips 40 to mitigate the undesirable effects of perspiration and heat buildup.

As can be seen in FIG. 11, a respective pressure nub 24 may be centrally disposed on the concave surface 22 of each one the cups 20 on the outer surface 54. As was earlier mentioned, the cups 20 and the pressure nubs 24 respectively provide shock absorption and massaging to a user's hand against impact. It is contemplated that the cup 20 perimeters may be circularly configured. Additionally, the diameters of the cups 20 may vary along the length of the core body 14. However, the diameters of the cup 20 perimeters may be constant throughout the length of the core body 14.

Although there are an infinite number of spacings of the cups 20 that may be utilized, as shown in FIGS. 11 and 12, the cups 20 may be arranged along the length of the core body 14 in a plurality of rows extending axially along the core body 14. The rows may be circumferentially spaced apart with each cup 20 in a row being offset in the axial direction from the cup 20 in an adjacent row. However, it is also contemplated that the center of any cup 20 on any row may be located at approximately the midpoint between the adjacent cup 20 in an adjacent row. Furthermore, it is contemplated that the cups 20 may be arranged according to areas of zones that are associated with various organs or muscles of the body per reflexology or acupressure charts in a manner similar to the contemplated arrangement of cups 20 on the shoe insole 12 of the first embodiment.

As in the first embodiment, the diameters of the cup 20 perimeters of the second embodiment may be formed in any number of sizes. In this regard, it is contemplated that there are any number of shapes and sizes that may be utilized for the cup 20 perimeters, including elliptical shapes to enhance gripping between the user's hand and the implement 36. The cup 20 perimeters may further be configured with a series of notches disposed therearound to enhance the massaging and blood circulation characteristics. The cup 20 perimeter may also be radially parted from the perimeter down to the pressure nub 24, forming a plurality of flaps which alternately flatten with pressure during gripping of the implement 36 to provide enhanced massaging properties.

The cross-section of the flaps may be of variable along the length of each flap in order to provide a mild, frictional massaging action between the flaps and the palm and/or fingers 44 of the user's hand. In addition, the cups 20 may be comprised of an upper one of the cups 20 and a lower one of the cups 20 that are stacked together wherein the upper one of the cups 20 having a generally concave or hemispherical shape is disposed above a second larger and lower one of the cups 20 which also has a generally concave or hemispherical shape.

The pressure nub 24 may be included within the lower upper one of the cups 20 to provide massaging effect to the user or wearer's hands, feet or other body part in contact with the massaging and reflexology system 10. It is contemplated that such a system 10 having axially stacked upper and lower ones of the cups 20 may be incorporated into the first embodiment or second embodiment of the massaging and reflexology system 10.

Regarding the materials that may be utilized for forming the shoe insole 12 of the first embodiment and the handle grip 40 of the second embodiment, it is contemplated that the core body 14, the cups 20, the cup spacers 26 and the pressure nubs 24 may be formed as a unitary structure of resilient, elastomeric material such as silicone gel or polyurethane, although many other materials may be workable. The core body 14, the cups 20, the cup spacers 26 and the pressure nubs 24 may each be formed of different materials having differing densities, resiliencies and durability characteristics. The density of the core body 14 and densities of the cups 20 may vary along the length of the core body 14. The core body 14 may be formed of silicone gel while the cup spacers 26 and cups 20 may be formed of silicone gel or polyurethane with the pressure nubs 24 being formed of a higher density material such as poly vinyl chloride (PVC) or plastic, although any combination of materials may be used.

In addition to PVC, other polymers such as ethylene vinyl acetate may also be utilized. In this regard, it is contemplated that the core body 14, the cups 20, the pressure nubs 24 and the cup spacers 26, if included, may be generally formed of any mix of materials that can provide and achieve the objectives of shock absorption and cushioning, resiliency for massaging effects, and acupressure or reflexology characteristics as applied by the pressure nubs 24 and/or the cups 20, either acting alone or in concert.

The materials may also be selected based on their shape-memory properties, softness characteristics, or any other desirable characteristics. In this regard, it is contemplated that materials such as polymers may be utilized. Such polymers may be selected based on their capability of withstanding deformations of up to several hundred percent while returning to their original shape after deformation. The materials may also be selected based on their mechanical strength, stiffness and resistance to chemical attack.

The operation of the first embodiment and second embodiment will now be discussed. Regarding the first embodiment of the shoe insole 12, during walking or running, the cups 20 are alternately compressed and extended back to their original shape during sequential application of pressure as the foot is translated from the heel portion 30 to the toe portion 34. The cups 20 flatten outward as pressure is applied, providing a spring-like effect against the impact of the article of footwear against the walking or running surface. In this regard, the cups 20 provide shock absorption to protect the user's ankles, knees, and other joints from injury. The core body 14, being constructed of a resilient material, provides additional cushioning and shock absorption. Once the cup 20 flattens to the level of the pressure nub 24, the sole of the foot will then contact the pressure nub 24. The pressure nub 24, having a reduced contacting surface area relative to the cup 20, essentially applies a point load to the sole of the foot.

In addition, if the pressure nubs 24 are formed of higher density material relative to the generally resilient material that may comprise the core body 14, the pressure nubs 24 will more readily depress into the bottom of the user's feet. As was mentioned above, the pressure nubs 24 exhibit acupressure or reflexology characteristics wherein the nerve endings in the foot are stimulated. Under reflexology theory, these stimulated nerve endings communicate the stimulation in the foot to specific organs and other parts of the body to ease tension and reduce fatigue of the user. If the shoe insole 12 includes cups 20 on the bottom surface 18 with pressure nubs 24 centrally disposed therein, then the pressure nubs 24 of the aligned cups 20 on the top surface 16 will be more readily depressed into the user's foot.

Cups 20 of the bottom surface 18, if so included in the shoe insole 12, may provide a gripping action with the sole of the article of footwear. The gripping action may enhance lateral stability and provide forward-aft support of the shoe insole 12 within the article of footwear. An additional benefit of the massaging and reflexology system 10 of the shoe insole 12 regards the air ventilation advantages. Due to the spacing of the cups 20 away from the top surface 16, improved air circulation may occur as internal air is exchanged with external air during the rhythmic application of pressure upon the cups 20 during use.

If cups 20 are provided on the bottom surface 18, air circulation may be provided between the bottom surface 18 and the sole of the article of footwear to maintain the shoe insoles 12 in a cool, dry condition. Furthermore, the increase in spacing between the cup 20 and the top surface 16 may result in improved air circulation between the shoe insole 12 and the bottom of the user's foot. The cup spacers 26 serve to extend the cups 20 away from the top surface 16 such that the massaging action of the cups 20 and the pressure nubs 24 may be enhanced due to an increase in the local application of pressure that may be provided by the relatively smaller support area of the cup spacers 26.

Regarding the operation of the second embodiment wherein the massaging and reflexology system 10 is incorporated into the handle grip 40 of an implement 36, the cups 20 are alternately compressed and extended back to their original shape during the application of pressure as when the handle grip 40 is squeezed. As pressure is applied, the cup 20 flattens outward providing a spring effect to protect the user's hands against impact such as may occur when hitting a golf ball with a golf club or when hitting a tennis ball with a tennis racket. The core body 14 provides additional cushioning and shock absorption due to its resilient properties. Once the cup 20 flattens down to the level of the pressure nub 24, the palm and/or fingers 44 of the hand will contact the pressure nub 24, resulting in the application of pressure to specific areas of the hand.

Working in a manner similar to the reflexology characteristics of the foot described above, nerve endings may be stimulated, with the stimulation being transmitted to specific organs. Regarding the ventilation properties of the massaging and reflexology system 10 of the second embodiment, the spacing of the cups 20 from the outer surface 54 provides improved air circulation to the hand which may reduce slippage caused by perspiration.

Such improved air circulation may additionally improve the dissipation of heat from the handle grip 40. The cup spacers 26 extend the cups 20 away from the outer surface 54 such that the massaging action of the cups 20 and the pressure nubs 24 may be enhanced due to an increase in pressure that may be provided by the relatively smaller support area of the cup spacers 26 as they bear against the pressure nub 24. The additional spacing provided by the cup spacers 26 also may enhance the ventilation properties.

In either the first embodiment, the second embodiment or any alternative embodiments of the massaging and reflexology system 10 described above, it should be noted that the geometric configuration including the size, shape, spacing, and general arrangement for all configurations of the cups 20, pressure nubs 24, core body 14, cup spacers 26 and air pockets may be applied to any one of the above-described embodiments and are not limited for use with the particular embodiment in which they were described.

Furthermore, it should be noted that each one of the cups 20 may include a perimeter that is generally cylindrically shaped. However, as is illustrated in FIGS. 1-13, the cups 20 may be generally hemispherically shaped with no cylindrically shaped portion extending toward the perimeter. In addition, a height of each one of the cups 20 is preferably, but optionally, less than a width of the cup 20 at the perimeter. Regarding the bumps or pressure nubs 24, if included, a height of the pressure nub 24 is preferably, but optionally, sized such that the pressure nub 24 does not protrude beyond the perimeter of the cup 20 within which it is disposed. In addition, the pressure nub 24 may preferably have a generally circular shape at a bottom end thereof where the pressure nub 24 intersects the cup. Such a configuration may provide a relatively quick retraction of the cup 20 as it is flattened under pressure. Furthermore, such a configuration of the pressure nub 24 may restrain the cup 20 from folding inwardly when pressure is applied thereto.

Regarding the cup spacer, if included, a height of the cup spacer 26 may be sized according to a particular location on the shoe insole 12, handle grip 40, or other application to which the massaging and reflexology system 10 may be applied. For example, the cup spacer 26 may be sized to provide increased massaging effect of the pressure nub 24 in the arch area of the shoe insole 12 while the height of the cup spacers 26 at the heel, toe and intermediate portions 30, 32, 34 of the shoe insole 12 are sized to have a smaller height.

As was earlier mentioned, the bottom surface 18 of the shoe insole 12 and the inner surface 52 of the handle grip 40 may be provided with air pockets in order to improve flexing and releasing of the cups 20 such that the massaging action is enhanced. The core body 14 may be provided in uniform or various thicknesses or combinations thereof. In addition, the core body 14 may be contoured in order to provide improved support for the particular body part upon which the system 10 may be contact. The pressure nubs 24, cup spacers 26, air pockets may be included or omitted as required in order to provide the desired interactive characteristics depending upon the particular application in which the system 10 is to be used.

Additional modifications and improvements of the present invention may also be apparent to those of ordinary skill in the art. Thus, the particular combination of parts described and illustrated herein is intended to represent only certain embodiments of the present invention, and is not intended to serve as limitations of alternative devices within the spirit and scope of the invention. For example, it is contemplated that the massaging and reflexology system 10 may be adapted for use in the conveyor tread of a treadmill, on bicycle seats, in cushioning devices such as car seats and exercise mats, as well as in back braces and neck braces. The same therapeutic benefits described in detail in the shoe insole 12 of the first embodiment and the handle grip 40 of the second embodiment may be provided by incorporation of the massaging and ref lexology system 10 into these additional devices.

What is claimed is;

1. A massaging and reflexology system comprising:

a core body defining opposing top and bottom surfaces;

a plurality of cups disposed on the top surface, each cup defining a substantially concave surface projecting outwardly from the top surface, the substantially concave surface defining a diameter that increases as the distance from the top surface of the core body increases; and a plurality of pressure nubs, a respective pressure nub centrally positioned with respect to the concave surface of each respective one of the plurality of cups.

2. The system of claim 1 wherein the core body is generally configured in the shape of a shoe insole with the top surface being contoured to generally match the shape of a human foot.

3. The system of claim 2 wherein the core body is generally configured in the shape of a heel portion of the shoe insole.

4. The system of claim 3 wherein the core body further includes an intermediate portion of the shoe insole.

5. The system of claim 1 wherein a thickness of the core body varies along a length thereof.

6. The system of claim 5 wherein:

the core body is generally configured in the shape of a shoe insole having a heel portion, an intermediate portion, a toe portion and an arch portion;

the thickness of the core body being greater at the heel and arch portions than at the intermediate and toe portions.

7. The system of claim 1 further comprising a plurality of cups disposed on the bottom surface, each cup defining a substantially concave surface projecting outwardly from the bottom surface.

8. The system of claim 1 further comprising a grid of orthogonally-arranged support webs extending perpendicularly from and disposed along the bottom surface.

9. The system of claim 1 wherein the core body is fabricated from a resilient, elastomeric material.

10. The system of claim 1 wherein the pressure nubs have a generally hemispherical shape.

11. The system of claim 1 wherein the cup perimeters are circular and diameters of the cups vary along a length of the core body.

12. The system of claim 1 wherein a density of the core body and densities of the cups vary along a length of the core body.

13. The system of claim 1 wherein the core body, the cups and the pressure nubs are formed as a unitary structure.

14. The system of claim 1 wherein the core body is sized and configured to circumscribe a handle grip of an implement.

15. The system of claim 1 wherein each one of the pressure nubs comprises:

an elongate protuberance projecting upwardly from and centrally-disposed within the concave surface; and a plurality of arched fingers radially-spaced about and extending upwardly from the concave surface toward the protuberance.

16. The system of claim 1 wherein each one of the pressure nubs comprises:

an inner, generally hemispherical bump; and a plurality of radially-spaced wedges extending upwardly from the concave surface and covering the hemispherical bump.

17. The system of Claim 1 further comprising at least one depression formed in the bottom surface of the core body.

18. The system of claim 1 wherein the depression is aligned to the cup and pressure nub.

19. The system of claim 1 wherein at least one of the plurality of cups includes an inner cup wall and an outer cup wall, the inner cup wall defining a concave surface and the outer cup wall defining a convex surface.

20. The system of claim 1 including at least four cups disposed on the top surface of the core body.

21. The system of claim 1 wherein the respective pressure nub is centrally disposed on the concave surface of each respective one of the plurality of cups.

22. A massaging and reflexology system comprising:

a core body defining opposing top and bottom surfaces, the core body being generally configured in the shape of a shoe insole with the top surface being contoured to generally match the shape of a human foot, the top surface being disposable in a direction facing toward a user and the bottom surface being disposable in a direction facing away from the user;

a plurality of cups disposed on the top surface, each cup defining a substantially concave surface projecting outwardly from the top surface, the substantially concave surface defining a diameter that increases as the distance from the top surface increases; and a plurality of pressure nubs, a respective pressure nub centrally disposed on and projecting outwardly from the concave surface of a respective one of the plurality of cups.

23. The system of claim 22, further comprising a plurality of cups disposed on the bottom surface, each cup defining a substantially concave surface projecting outwardly from the bottom surface.

24. The system of claim 22, wherein the core body is fabricated from a resilient, elastomeric material.

25. The system of claim 22, wherein at least one of the plurality of cups includes an inner cup wall and an outer cup wall, the inner cup wall defining a concave surface and the outer cup wall defining a convex surface.

26. The system of claim 22, wherein the core body, the cups and the pressure nubs are formed as a unitary structure.

* * * * *